United States Patent [19]

Morrow et al.

[11] Patent Number: 5,051,724

[45] Date of Patent: Sep. 24, 1991

[54] KEY SECURITY DEVICE

[75] Inventors: Carl R. Morrow, Longview; G. Jeff Maestretti, Walla Walla, both of Wash.

[73] Assignees: Carl R. Morrow, Longview; G. Jeff Maestretti, Walla Walla, both of Wash.

[21] Appl. No.: 531,020

[22] Filed: May 31, 1990

[51] Int. Cl.[5] ..... G08B 13/14

[52] U.S. Cl. ..... 340/568; 70/456 R; 200/61.66

[58] Field of Search ..... 340/568, 527, 571, 301, 340/302, 305, 306, 296, 286.08; 70/6, 8, 10, 60, 456 R, 459; 206/37.1; 116/80; 200/61.66, 43/05

[56] References Cited

U.S. PATENT DOCUMENTS

| | | | |
|---|---|---|---|
| 1,571,425 | 2/1926 | Matloni | 70/459 |
| 2,519,940 | 8/1950 | Smith et al. | 340/568 |
| 2,694,244 | 11/1954 | Nolan | 70/459 |
| 2,982,454 | 5/1961 | Wolberg | 70/456 |
| 4,012,732 | 3/1977 | Herrick | 340/568 |
| 4,391,113 | 7/1983 | Jorgens | 70/459 |
| 4,440,011 | 4/1984 | Klein | 70/432 |
| 4,558,307 | 12/1985 | Lienart van Lidt de Jeude | 340/527 |
| 4,570,469 | 2/1986 | Neilsen | 70/389 |
| 4,652,865 | 3/1987 | Maharshak | 340/568 |
| 4,719,453 | 1/1988 | Beck et al. | 340/568 |
| 4,864,279 | 9/1989 | Cooper | 340/568 |
| 4,939,917 | 7/1990 | Cartwright | 70/456 R |

FOREIGN PATENT DOCUMENTS

| | | | |
|---|---|---|---|
| 0340078 | 11/1989 | European Pat. Off. | 70/456 R |

*Primary Examiner*—Edward L. Coles, Sr.
*Assistant Examiner*—Brent A. Swarthout
*Attorney, Agent, or Firm*—Wells, St. John & Roberts

[57] ABSTRACT

A key security device includes a rigid housing with an internal latching device to releasably secure a key within an open keyway formed in the housing. Circuitry is provided along with the latching device to supply an audible or otherwise detectable signal that is initiated following removal of the key and passage of a predetermined timed interval following removal of the key from the housing. Circuitry within the housing responds to insertion and removal of the key to produce an indentifiable alert signal after a determined time interval that may be initiated in response to removal of the key from the keyway. The time interval is reset and the alert signal is cancelled as the key is received in the keyway. An override is provided for the timer and may be operated to selectively extend the time interval and thereby delay operation of the alarm.

17 Claims, 3 Drawing Sheets

KEY SECURITY DEVICE

FIELD OF THE INVENTION

The present invention relates to devices for securing a key and for warning that the key has been removed from the security device after a preselected time interval.

BACKGROUND OF THE INVENTION

Security institutions such as prisons, mental hospitals, etc., require strict control of keys. In the example of a prison, guards must be especially cautious to maintain control of his or her keys. Unauthorized removal of a key could result in a serious, even life threatening, predicament.

It is therefore desirable to assist guards or others charged with maintaining security keys to (a) hold a key secure and to (b) assist the individual remember the present location of the key and, following use, to encourage quick re-securement of the key.

Various apparatus has been developed to warn that keys have been misplaced. For example, U.S. Pat. No. 4,558,307 to Leinart van Lidt de Jeude discloses a reminder device that may be attached to a key, wallet, etc. It includes an electronic circuit with a time delay arrangement connected to a photo sensitive audio signalling device that functions to emit an audible signal after the reminder device has been irradiated by ambient radiation for a selected period of time. The device is attached directly to the key and hence travels with the key.

U.S. Pat. No. 4,012,732 to Herrick discloses a security device in which an inanimate object such as a key is placed in a receptacle for free access. The receptacle is connected to a clock that is set to operate an alarm following a predetermined time interval if a sensor does not detect human activity in the area of the receptacle. Sensors are provided to detect the presence of the key in the receptacle and operate when the key is removed from the receptacle to override the alarm after the predetermined time period has passed.

U.S. Pat. No. 4,652,865 to Maharshak discloses a credit card holder warning device in which credit cards are received in a holder including opposed card cover surfaces. The surfaces include electrical contact strips that make electrical contact when a credit card is withdrawn from the carrier. The card holder includes a timer and alarm that are switched on and off by the contacts. The timer delays the operation of the alarm for a set time sufficient to complete a transaction. After the prescribed transaction time period, the alarm device is actuated, indicating to the user that the card has not been returned to the card holder. Apart from the card holder, there is no device selectively securing the card in position within the holder or for securing the holder to the user.

U.S. Pat. No. 4,719,453 to Beck et al. discloses a card carrier alarm somewhat similar to the Maharshak reference described above with the exception that the Beck apparatus does not include a timer and includes further provisions for triggering an alarm when the card is missing from the carrier and the carrier is placed in a pocket or purse.

The above apparatus are not addressed to the problem of providing a security device for a key in which the key may be secured against unauthorized removal when not in use, and which will produce an audible or otherwise detectable signal after the key has been removed for a selected time interval.

It is therefore an object of the present invention to provide a key security device in which provisions are made both to secure a key against unintended or unauthorized removal, and to produce a detectable alarm after the key has been removed for a selected period of time.

It is a further object to provide such a device in which the selected period of time may be selectively reset by the user without returning the key to the security device.

A still further object is to provide such a device in which the security device itself may be secured to a user.

These and other objects and advantages will become apparent upon reading the following detailed description which, taken with the accompanying drawings, describe a preferred form of the present invention.

BRIEF DESCRIPTION OF THE DRAWINGS

A preferred embodiment of the invention is illustrated in the accompanying drawings, in which.

DETAILED DESCRIPTION OF THE PREFERRED EMBODIMENTS

The following disclosure of the invention is submitted in furtherance with the constitutional purpose of the Patent Laws "to promote the progress of science and useful arts" (Article 1, Section 8).

Figure 1:
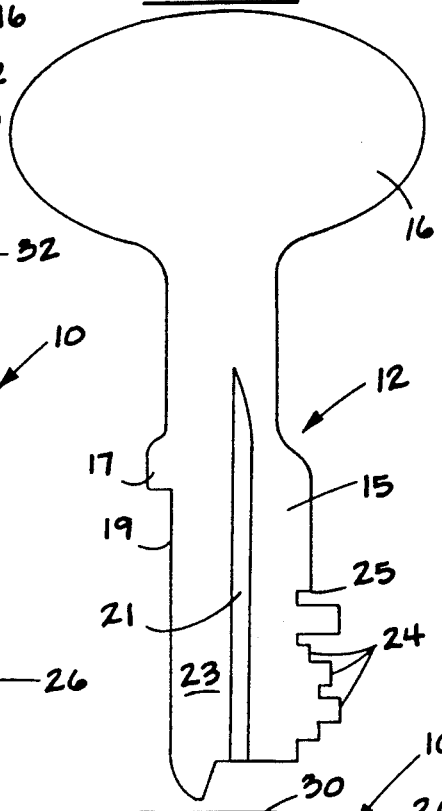
FIG. 1 is a perspective view of a standard key.

A key security device is generally indicated in the drawings by the reference numeral 10. The key security device 10 represents a preferred example of the present invention for releasably holding a key 12 (FIG. 1).

For purposes of describing the security device 10 further, several features of the key 12 will first be discussed. The key 12 includes an elongated blade 15 extending from a bow end 16. A shoulder 17 is provided on the blade along one longitudinal edge 19 of the blade. Cuts 24 are situated along an opposite side edge 25 of the blade. A ward groove 21 extends longitudinally along a side surface 23 of the blade.

Figure 8:
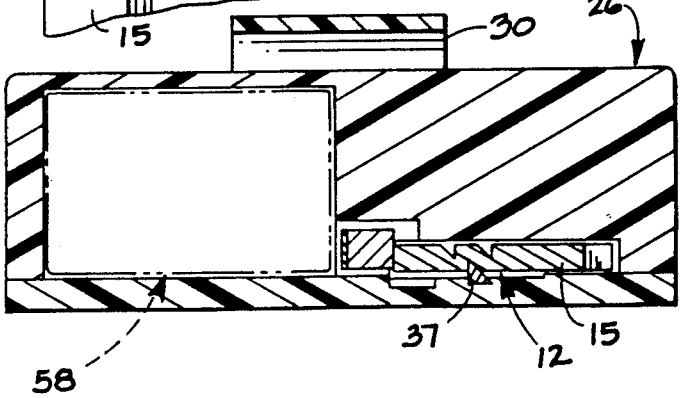
FIG. 8 is a cross-sectional view taken substantially along line 8—8 in FIG. 2.

The preferred key security device 10 (FIG. 2) includes a housing 26. The housing 26 may be formed of any suitable relatively rigid, lightweight material such as appropriate plastics or aluminum. A bracket 30 (FIGS. 3, 8) is provided on the housing along a rear surface thereof for secure attachment to a users garment. The bracket 30 may be in the form of a belt loop to facilitate mounting of the device to the user's belt. Other forms of bracket 30 may also be utilized, such as buttons, clasps, etc. to releasably secure the housing, preferably in a selected position on the user's garment.

The belt loop bracket 30 is presently preferred since hand access to a key is convenient at the belt level.

Figure 2:
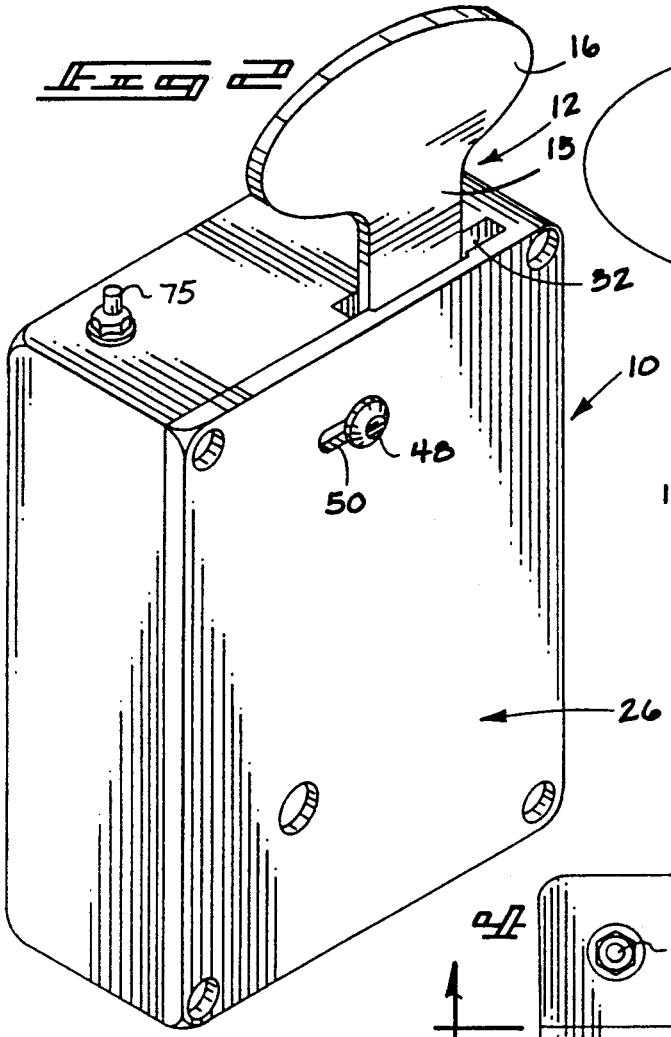
FIG. 2 is a pictorial view of the key mounted in the present key security device.
Figure 3:
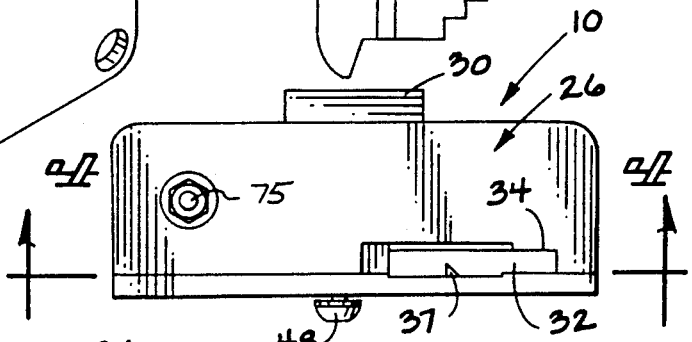
FIG. 3 is a top plan view of the present security device.

An elongated keyway 32 is formed in the housing 26. The keyway extends from an upper open end 34 into the housing for longitudinally receiving the key blade 15. The keyway 32 is shaped in similar cross-sectional configuration to the overall cross-sectional shape of the key as may be noted in FIG. 8 of the drawings. The keyway is slightly larger than the cross-sectional configuration of the key blade in order to loosely yet slidably receive the length of the key blade therein. The overall length of the keyway 32 is such that the blade length is received, but the bow end 16 of the key projects upwardly above the keyway open end 34 (FIG. 2).

A ward bar 37 (FIGS. 3, 8) is provided in the housing along keyway 32. Ward bar 37 is received within the ward groove 21 of the key. Ward bar 37 is secured to the housing and is received within the ward groove 21 in order to hold the key blade against lateral motion in the keyway. It thus prevents motion of the key in right or left hand directions as viewed in FIG. 8. The ward bar 37 permits relatively free longitudinal sliding motion of the key blade into or away from the keyway 32. Ward bar 37 is preferably formed of metal and is secured in stationary relation to the front cover of the housing 26.

A latch 42 is provided on the housing and is shown in detail in FIGS. 4–7. The latch 42 is selectively movable between: (a) a locking position in engagement with the key (FIG. 7) to releasably lock the key 12 to the housing 26, and (b) a release position (FIG. 6) allowing the key to be withdrawn from the keyway.

The latch 42 is advantageously comprised of a bolt 44. The bolt 44 slides substantially linearly within a complementary shaped transverse groove formed within the housing. A spring 45 is mounted in the groove between the bolt 44 and housing. The spring 45 urges the bolt normally into the keyway toward the locking position.

A manual release 48 is provided on the bolt 44 and is shown in FIG. 2. The manual release 48 enables manual movement of the bolt 44 to the retracted, release position thereby allowing removal of the key from the keyway. The manual release 48 is mounted within a slot 50 (FIG. 2) in the housing.

Figure 5:
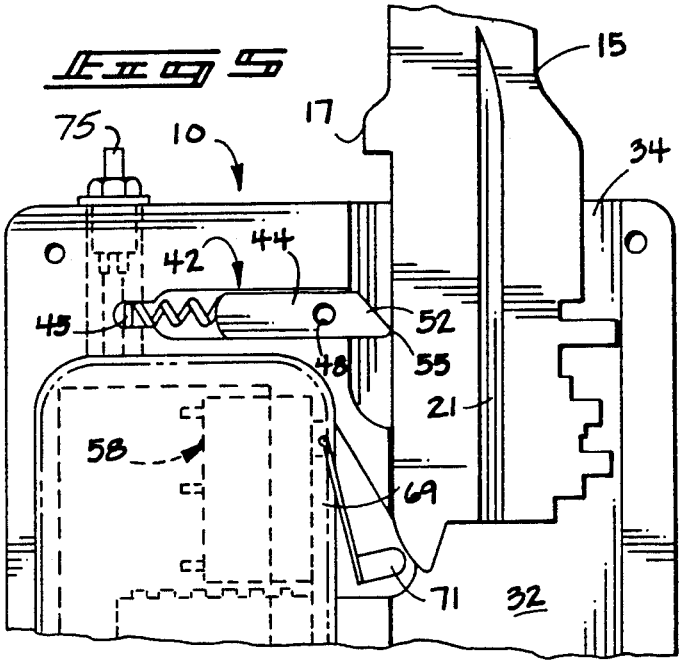
FIGS. 5–7 are fragmented view illustrating relative positions of the security device components and a key blade.
Figure 7:
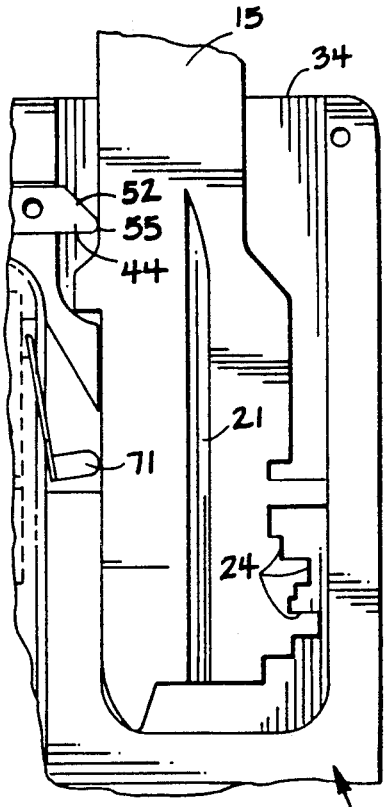
Figure 6:
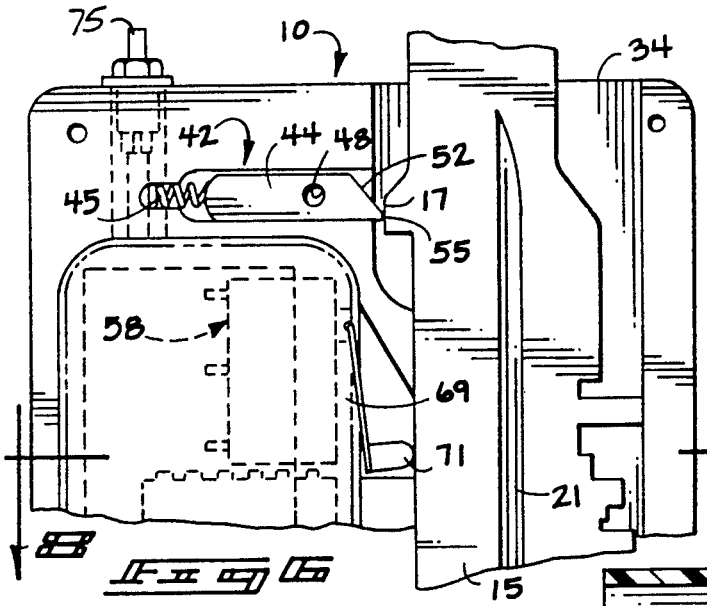

The bolt 44 includes an inclined end surface 52 (FIGS. 5–7). The inclined end surface 52 is oriented to engage and cam against the key blade shoulder 17 as the key 12 is inserted into the keyway. This motion may be understood by referring to FIGS. 5, 6, and 7 in sequence. The key 12 is inserted to the point where the shoulder 17 engages the bolt inclined end surface 52. The inclined surface 52 and the forcible contact with the key shoulder 17 causes the bolt 44 to slide back into the groove 43 as the key 12 is forced on downwardly (FIG. 6) into the keyway 32. Finally, the bolt snaps back again as the shoulder 17 passes the inclined end surface 52.

The key 12 is now locked in position within the housing. The inclined surface 52 is no longer engaged by the key shoulder. Instead, the pointed end 55 of the inclined end surface 52 engages the key blade above the shoulder and will not permit removal of the key. If an attempt is made to retract the key, the bolt will bind within the bolt groove 43 and will not retract. The key is therefore locked securely in position within the housing 26.

Of course, the manual release 48 may be moved by hand to retract the bolt 44 and allow removal of the key. However, without operation of the manual release 48, the key can not be effectively removed from the housing. The end surface 55 thus represents a locking surface for engaging the key as the blade is inserted into the keyway.

Figure 4:
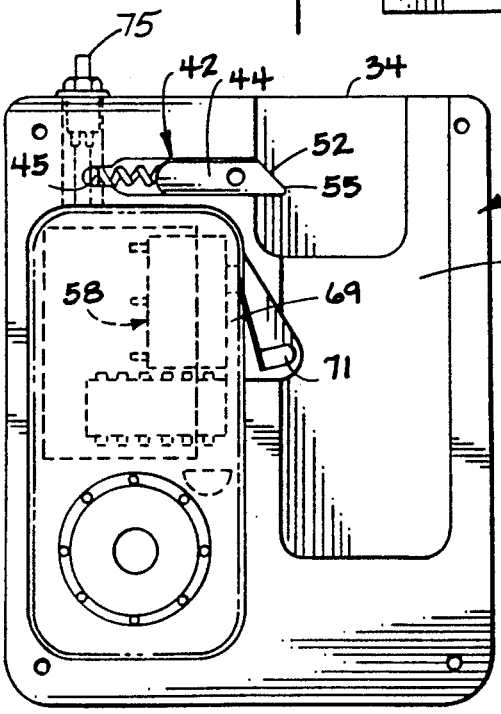
FIG. 4 is a front elevation view of the security device with the front portion of the housing removed.
Figure 9:
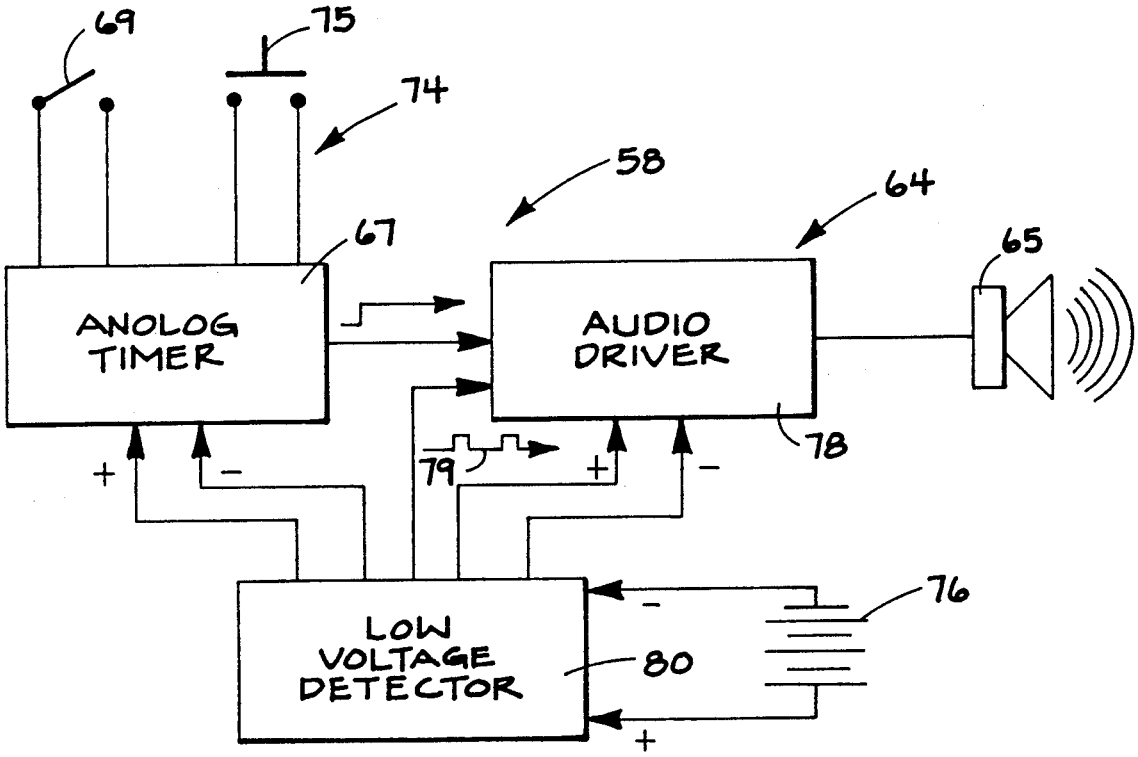
FIG. 9 is a schematic view of the colored device for the present key security device.

FIGS. 4 and 9 show an alert device 58 that is situated in the housing and is operable responsive to insertion and removal of the key from the keyway. The alert device 58 is provided to produce an identifiable alert signal after a selected time interval has passed following removal of the key 12 from the keyway 32. The alert device 58 also functions to reset the selected time interval and cancels the alert signal responsive to reception of the key in the keyway.

The alert device includes a signal generator circuit 64 made up of conventional components that is useful to produce an identifiable alert signal. The preferred signal generator circuit includes a signal producing device such as a conventional audio enunciator 65 capable of producing a loud, audible alarm when energized.

The alert device also includes a timer circuit 67 used to activate the signal generator circuit after a prescribed time interval, say 35 seconds, has elapsed. The timer circuit 67 may include an appropriate user adjustable analog timing device, with the elapsed time set according to the usual activities planned for use of the associated key. Such timers 67 are commercially available.

The timer circuit 67 is advantageously controlled by a conventional switch 69 within the housing, having an operator 71 extending into the keyway. The operator 71 extends into the keyway to engage the key blade upon insertion of the key into the keyway. This procedure is clearly understandable viewing FIGS. 5–7 in sequence. There the switch operator 71 is being pressed inwardly by the key blade as the blade is inserted into the keyway.

The operator 71 in the depressed position shown in FIGS. 6 and 7, serves to turn the alarm circuitry "off" and resets the timer circuit 67. The alert device therefore will remain dormant until the key is removed.

The key is removed by operating the manual release 48 and pulling the key upwardly out of the keyway. In doing so the steps described above for insertion of the key are reversed. Thus, the key is retracted and the sequence is substantially as shown in FIGS. 7, 6 and 5. Here it may be noted that the switch operator 71 swings to an extended position shown in FIG. 5 as the key is retracted. The operator 71 alters the state of the switch which then activates the timer circuit 67. A prescribed time interval then elapses. After the end of the prescribed time interval, during which time the key 12 is absent from the keyway, the signal generator circuit is activated to operate the annunciator 65 and an audible alarm is sounded. This indicates to the user that the key has been absent from the housing for the prescribed time period.

An override circuit 74 is provided to extend the time interval with the key removed from the housing. The override may be comprised of a momentary contact button type switch 75 mounted on the housing and electrically connected to the timer circuit 67. Depression of the button switch 75 functions to reset the timer and effectively extends the time before the alarm sounds. The operator is therefore able to selectively reset the timer to run another interval if he or she would like to keep the key out longer than the initial time interval normally allows.

The electrical components described above may be driven by a battery 76 preferably a lithium rechargeable battery, connected by conventional circuitry through the timer circuit 67 and an audio driver 78 to the output annunciator 65. The battery 76 is advantageously connected to the timer 67 and driver 78 through a low voltage detector 80.

The low voltage detector 80 is provided using conventional components to warn that the battery requires recharging or replacement. The low voltage detector 80 may be provided to produce a pattern of on-off signals 79 to the driver and annunciator. The result is an easily recognizable low voltage warning alarm that will be easily distinguishable from the alert signal produced following a prescribed time interval after removal of the key from the keyway. Thus, low voltage alarms will be discernable from the alarm sounded when the device is in normal operation.

In compliance with the statute, the invention has been described in language more or less specific as to structural features. It is to be understood, however, that the invention is not limited to the specific features shown, since the means and construction herein disclosed comprise a preferred form of putting the invention into effect. The invention is, therefore, claimed in any of its forms or modifications within the proper scope of the appended claims appropriately interpreted in accordance with the doctrine of equivalents.

We claim:

1. A key security device for releasably holding a key having an elongated blade extending from a bow end, a shoulder on one longitudinal edge of the blade, and a ward groove extending longitudinally along a side surface of the blade, the device comprising:

a housing;

an elongated keyway formed in the housing with an open end for receiving the key blade longitudinally;

a bar in the housing for holding the key blade against lateral movement within the keyway;

a latch on the housing selectively operable between a locking position in engagement with the key to releasably lock the key to the housing and a release position allowing the key to be withdrawn from the keyway; and an alert device within the housing responsive to insertion and removal of the key from the housing for producing an identifiable alert signal after a selected time interval initiated in response to removal of the key from the keyway, and for resetting the selected time interval and cancelling the alert signal responsive to reception of the key in the keyway.

2. The key security device of claim 1 wherein the bar projects into the keyway and is slidably engagable within the ward groove of the key.

3. The key security device of claim 1 wherein the alert device is electrically driven and further includes an override switch connected to a timer of an alert device, selectively operable to extend the time interval with the key removed from the keyway before an alert signal is produced.

4. The key security device of claim 1 wherein the latch includes:

a bolt mounted on the housing and projecting into the keyway, with a locking surface for engaging the key as the key blade is inserted into the keyway;

a spring mounted between the bolt and the housing for normally biasing the bolt to a locking position with the locking surface engaged and against the key blade length in the keyway, and a manual release mounted to the bolt to enable manual movement of the bolt to a retracted position clear of the key, thereby allowing removal of the key from the keyway.

5. The key security device of claim 1 wherein the key includes a shoulder on the longitudinal side edge thereof and wherein the latch includes:

a spring biased bolt mounted on the housing and projecting into the keyway, with an inclined end surface for engaging and camming over the shoulder on the key as the key blade is inserted into the keyway;

a locking surface on a side opposite to the inclined end surface to engage and lock against the key shoulder as the key blade length is fully received in the keyway, and a manual release mounted to the bolt and projecting from the housing for hand access to enable manual movement of the bolt to a retracted position clear of the key, thereby allowing removal of the key from the keyway.

6. The key security device of claim 1 further comprising a bracket on the housing for secure attachment to a user's garment.

7. The key security device of claim 1 wherein the alert device is electrically driven, including;

a signal generator circuit operable, when activated, to produce an identifiable alert signal;

a timer circuit operatively connected to the signal generator to activate the signal generator circuit after a selected time interval has elapsed; and a switch mounted to the housing and having an operator projecting into the keyway for engagement with the key blade for activating and deactivating the timer circuit responsive respectively to reception and removal of the key from the keyway.

8. The key security device of claim 7 wherein the alert device further includes a timer override selectively operable to extend the time interval with the key removed from the keyway.

9. A key security device for releasably holding a key having an elongated blade extending from a bow end, a shoulder on a longitudinal edge of the blade, and a ward groove extending longitudinally along a side surface of the blade, the device comprising:

a housing;

an elongated keyway formed in the housing with an open end for receiving the key blade longitudinally;

a ward bar on the housing and projecting into the keyway to be received by the ward groove along the key blade to hold the key blade against lateral movement within the keyway;

a latch on the housing for movement thereon between a locking position in engagement with the key blade to releasably lock the key blade to the housing and a release position to allow the key to be withdrawn from the keyway;

a signal generator circuit operable, when activated, to produce an identifiable alert signal;

a timer circuit operatively connected to the signal generator to activate the signal generator circuit after a selected time interval has elapsed; and switch means operatively connected to the timer circuit responsive to presence and absence of the key blade in the keyway for activating the timer circuit when the key is absent from the keyway and for deactivating the timer circuit when the key is present in the keyway so the identifiable alert signal will only be produced when the key is absent from the keyway for a time greater than the selected time interval of the timer circuit.

10. The key security device of claim 9 further including an override switch connected to the timer circuit and selectively operable to extend the time interval with the key removed from the keyway before an alert signal is produced.

11. The key security device of claim 9 wherein the switch means is comprised of a switch mounted to the housing and having an operator projecting into the keyway for engagement with the key blade for activating and deactivating the timer circuit responsive respectively to reception and removal of the key from the keyway.

12. The key security device of claim 9 wherein the latch includes:

a spring biased bolt mounted on the housing and projecting into the keyway, with an inclined end surface for engaging and camming over the shoulder on the key as the key blade is inserted into the keyway;

a locking surface on a side opposite to the inclined end surface to engage and lock against the key shoulder as the key blade length is fully received in the keyway, and a manual release mounted to the bolt for hand access to enable manual movement of the bolt to a retracted position clear of the key, thereby allowing removal of the key from the keyway.

13. The key security device of claim 12 further comprising a belt receiving bracket on the housing for secure attachment to a user's belt.

14. A key and security device combination, comprising:

a key having an elongated blade extending from a bow end, a shoulder on a longitudinal edge of the blade, and a ward groove extending longitudinally along a side surface of the blade;

a housing;

an elongated keyway formed in the housing with an open end for receiving the key blade longitudinally;

a ward bar on the housing and projecting into the keyway to be received by the ward groove along the key blade to hold the key blade against lateral movement within the keyway;

a latch on the housing for movement thereon between a locking position in engagement with the key blade to releasably lock the key blade to the housing and a release position to allow the key to be withdrawn from the keyway;

a signal generator circuit operable, when activated, to produce an identifiable alert signal;

a timer circuit operatively connected to the signal generator to activate the signal generator circuit after a selected time interval has elapsed; and switch means operatively connected to the timer circuit responsive to presence and absence of the key blade in the keyway for activating the timer circuit when the key is absent from the keyway and for deactivating the timer circuit when the key is present in the keyway so the identifiable alert signal will only be produced when the key is absent from the keyway for a time greater than the selected time interval of the timer circuit.

15. The key and security device combination of claim 14, further comprising:

an override switch connected to the timer circuit and selectively operable to extend the time interval with the key absent from the keyway before an alert signal is produced.

16. The key and security device combination of claim 15 wherein the latch further comprises:

a spring biased bolt mounted on the housing and projecting into the keyway, with an inclined end surface for engaging and camming over the shoulder on the key as the key blade is inserted into the keyway;

a locking surface on a side opposite to the inclined end surface to engage and lock against the key shoulder as the key blade length is fully received in the keyway, and a manual release mounted to the bolt for hand access to enable manual movement of the bolt to a retracted position clear of the key, thereby allowing removal of the key from the keyway.

17. The key and security device combination of claim 16 wherein the switch means is comprised of a switch mounted to the housing and having an operator projecting into the keyway for engagement with the key blade for activating and deactivating the timer circuit responsive respectively to reception and removal of the key from the keyway.

* * * * *